US008764470B2

(12) United States Patent
Little et al.

(10) Patent No.: US 8,764,470 B2
(45) Date of Patent: Jul. 1, 2014

(54) BOARD TO BOARD CONNECTOR WITH ENHANCED METAL LOCKING FEATURES

(75) Inventors: Terrance F. Little, Fullerton, CA (US); Hung-Yang Yeh, New Taipei (TW); Chia-Pin Liu, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 193 days.

(21) Appl. No.: 13/526,538

(22) Filed: Jun. 19, 2012

(65) Prior Publication Data

US 2013/0337681 A1 Dec. 19, 2013

(51) Int. Cl.
*H01R 12/00* (2006.01)
*H01R 13/73* (2006.01)

(52) U.S. Cl.
USPC ..... 439/284; 439/570

(58) Field of Classification Search
USPC ..... 439/284, 266, 270
See application file for complete search history.

(56) References Cited

U.S. PATENT DOCUMENTS

| | | | | |
|---|---|---|---|---|
| 5,411,236 | A | 5/1995 | Morita et al. | |
| 5,498,167 | A * | 3/1996 | Seto et al. | 439/74 |
| 6,702,590 | B2 * | 3/2004 | Zaderej et al. | 439/74 |
| 7,320,606 | B2 * | 1/2008 | Midorikawa | 439/74 |

* cited by examiner

*Primary Examiner* — Neil Abrams
(74) *Attorney, Agent, or Firm* — Wei Te Chung; Ming Chieh Chang

(57) ABSTRACT

An electrical connector includes an insulative housing defining a mating slot, a number of contacts and a pair of metal hold downs fastened in the insulative housing. Each contact includes a contacting portion extending into the mating slot. Each metal hold down includes a first portion, a second portion perpendicular to the first portion and a connecting portion connecting the first portion and the second portion. The first portion defines a first hole, the second portion defines a second hole for maintaining solders, and the connecting portion defines a third hole connecting the first hole and the second hole. The first portion and the connecting portion are insert molded in the insulative housing with material of the insulative housing filling in the first and the third holes.

20 Claims, 10 Drawing Sheets

BOARD TO BOARD CONNECTOR WITH ENHANCED METAL LOCKING FEATURES

BACKGROUND OF THE INVENTION

1. Field of the Invention

The present disclosure relates to board to board connectors, and more particularly to hermaphroditic board to board connectors with enhanced metal locking features for reliable retention.

2. Description of Related Art

Because of the continuing demand for smaller and slimmer portable electronic devices, it is necessary to develop these devices utilizing small form factor connectors, that provide a combination for overall space reduction, and reliable electrical contact, that will not compromise performance. Miniature low-profile board-to-board connectors offer maximum space savings for mobile devices, in order to meet surging market demand for downsizing of mobile portable devices. The development of these low-profile board-to-board connectors will provide maximum performance in a low profile form factor, with fine pitch.

A conventional board-to-board connector includes an insulative housing, a plurality of contacts retained in the insulative housing and a pair of metal hold downs fixed in the insulative housing for soldering to a PCB. However, since the profile of the board-to-board connector becomes lower and lower, how to reliably fasten the metal hold downs in the insulative housing becomes a big problem to those of ordinary skill in the art.

Hence, it is desirable to provide a board to board connector with enhanced metal locking features for reliable retention.

BRIEF SUMMARY OF THE INVENTION

The present disclosure provides an electrical connector including an insulative housing defining a longitudinal mating slot, a number of contacts retained in the insulative housing and a pair of metal hold downs fastened in opposite ends of the insulative housing. Each contact includes a contacting portion extending into the mating slot. Each metal hold down includes a first portion, a second portion perpendicular to the first portion and a connecting portion connecting the first portion and the second portion. The first portion defines a first hole, the second portion defines a second hole for maintaining solders, and the connecting portion defines a third hole connecting the first hole and the second hole. The first portion and the connecting portion are insert molded in the insulative housing with material of the insulative housing filling in the first and the third holes.

Besides, the present disclosure provides an electrical connector including an insulative housing, a plurality of contacts retained in the insulative housing and a pair of metal hold downs fastened in opposite ends of the insulative housing. Each metal hold down includes a first portion, a second portion perpendicular to the first portion, a connecting portion connecting the first portion and the second portion, and a reinforcement protrusion extending downwardly from the first portion. A gap is formed between the connecting portion and the reinforcement protrusion. The first portion and the connecting portion are insert molded in the insulative housing with material of the insulative housing filling in the gap.

The foregoing has outlined rather broadly the features and technical advantages of the present disclosure in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present disclosure, and the advantages thereof, reference is now made to the following descriptions taken in conjunction with the accompanying drawings, in which.

DETAILED DESCRIPTION OF THE PREFERRED EMBODIMENTS

Figure 1:
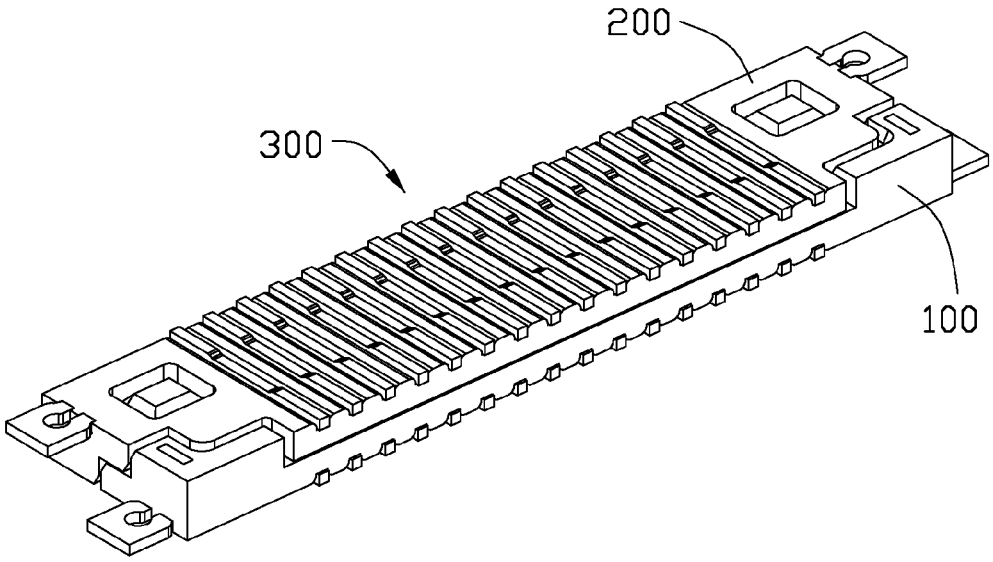
FIG. 1 is a perspective view of a board to board connector assembly with a plug connector and a receptacle connector mateable with each other in accordance with a first embodiment of the present disclosure.
Figure 2:
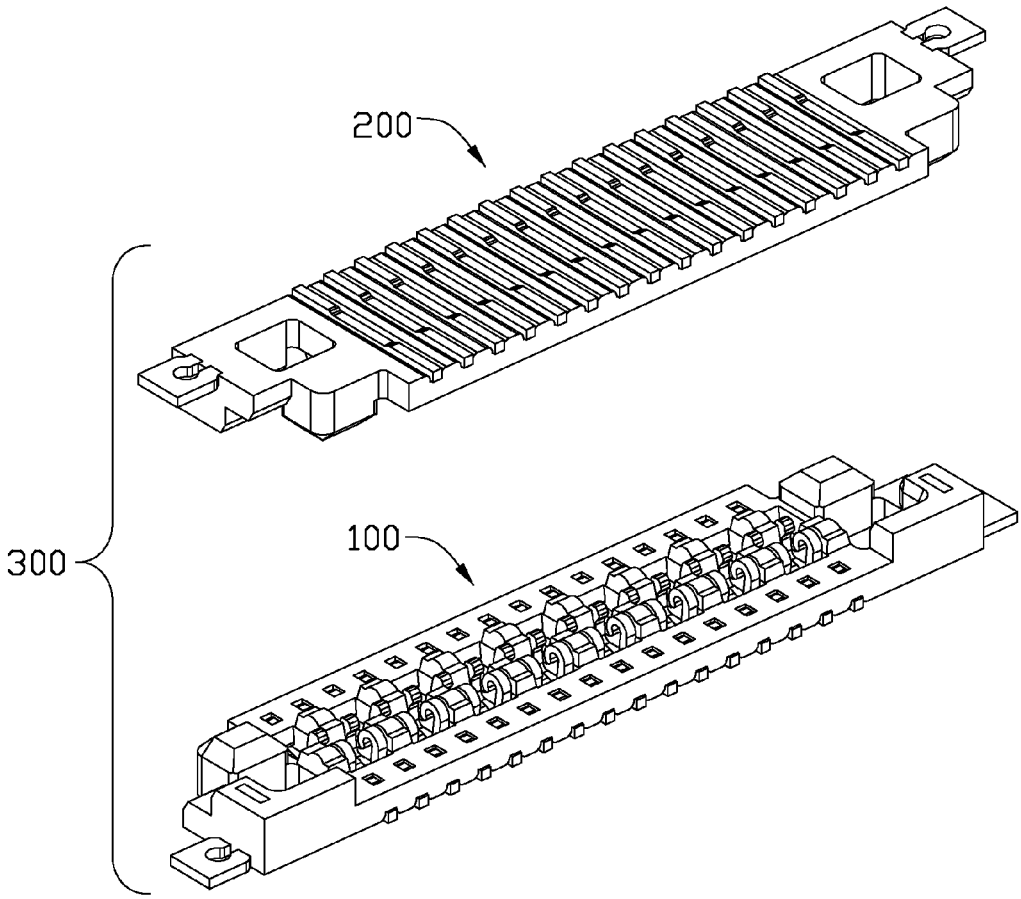
FIG. 2 is a perspective view of the board to board connector assembly as shown in FIG. 1 with the plug connector separated from the receptacle connector.

Reference will now be made to the drawing figures to describe the preferred embodiment of the present disclosure in detail. As shown in FIGS. 1 to 5, the illustrated embodiment of the present disclosure discloses a board to board connector assembly 300 including a plug connector 100 and a receptacle connector 200 for mating with the plug connector 100. The plug connector 100 and the receptacle connector 200 are truly identical and have the same structure for saving costs and reducing inventory. It is understandable to those of ordinary skill in the art that either the plug connector 100 or the receptacle connector 200 can be regarded as a board to board connector.

Figure 3:
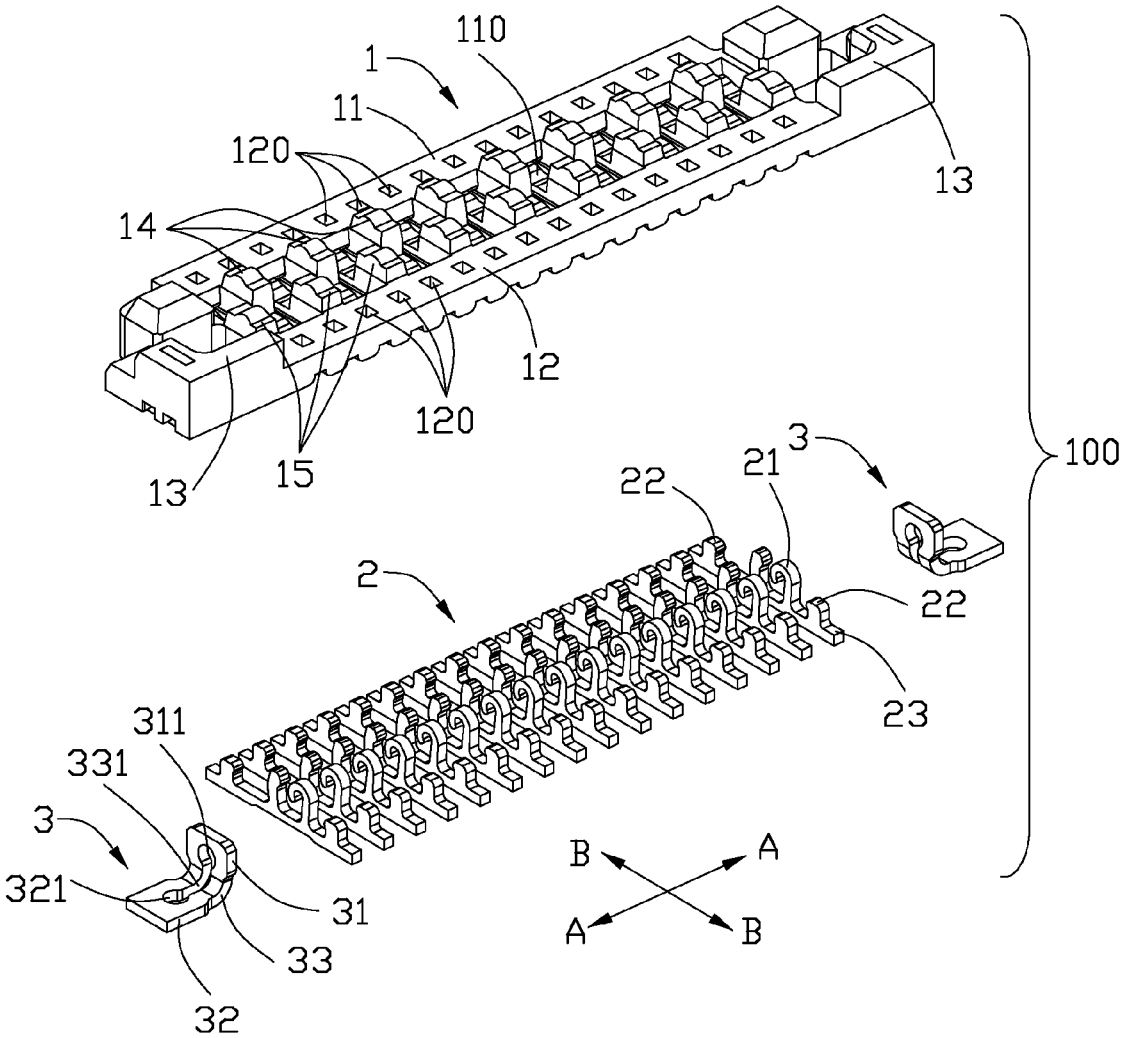
FIG. 3 is an exploded view of the plug connector or the receptacle connector with contacts and a pair of metal hold downs separated from an insulative housing.

Referring to FIG. 3, since the plug connector 100 and the receptacle connector 200 have the same configurations, only the plug connector 100 will be taken for example and described in detail. The plug connector 100 includes an insulative housing 1 extending along a longitudinal direction A-A, a plurality of contacts 2 fixed in the insulative housing 1 and a pair of metal hold downs 3 fastened to opposite ends of the insulative housing 1.

The insulative housing 1 includes a first mounting wall 11, a second mounting wall 12 opposite to the first mounting wall 11, a mating slot 110 formed between the first and the second mounting walls 11, 12, and a pair of shoulders 13 positioned on opposite ends of the insulative housing 1 along the longitudinal direction A-A. Each of the first mounting wall 11 and the second mounting wall 12 defines an array of mounting holes 120 for retaining the contacts 2. Besides, the insulative housing 1 includes an array of first positioning blocks 14 and an array of second positioning blocks 15. The first positioning blocks 14 are integral with the first mounting wall 11 and the second positioning blocks 15 are integral with the second mounting wall 12. The first positioning blocks 14 and the second positioning blocks 15 are arranged facing each other while they are offset from each other along a transverse direction B-B perpendicular to the longitudinal direction A-A.

Referring to FIG. 3, each contact 2 includes a curved contacting portion 21 protruding into the mating slot 110, a pair of fixing portions 22 retained in the mounting holes 120 and a pair of horizontal soldering portions 23 extending oppositely from the fixing portions 22. Each contacting portion 21 is positioned adjacent to and sidewardly depends on the corresponding first and the second positioning blocks 14, 15. The first and the second positioning blocks 14, 15 function not only as guiding members when the plug connector 100 and the receptacle connector 200 get mated, but also as protectors for protecting the contacts 2.

The metal hold down 3 is stamped and bent from a single metal sheet. Each metal hold down 3 includes a first portion 31 located in a vertical plane, a second portion 32 located in a horizontal plane and a connecting portion 33 connecting the first and the second portions 31, 32. The connecting portion 33 is contractive with respect to the first and the second portions 31, 32 for being easily bent. The first portion 31 defines a first hole 311, the second portion 32 defines a second hole 321, and the connecting portion 33 defines a third hole 331 connecting the first hole 311 and the second hole 321. The first hole 311 and the second hole 321 are round. The third hole 331 is narrower than the first hole 311 and the second hole 321. With the first, the second and the third holes 311, 321, 331 communicate with each other, they can be simultaneously formed in a single stamping step.

Figure 4:
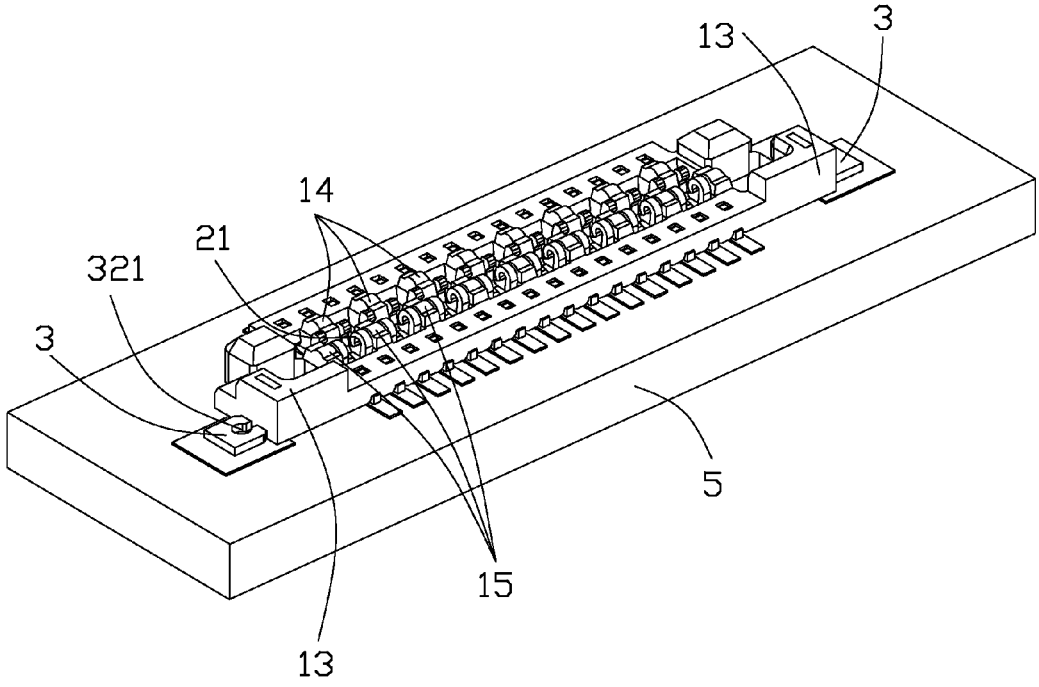
FIG. 4 is a perspective view of the plug connector or the receptacle connector mounted upon a PCB before soldering.
Figure 5:
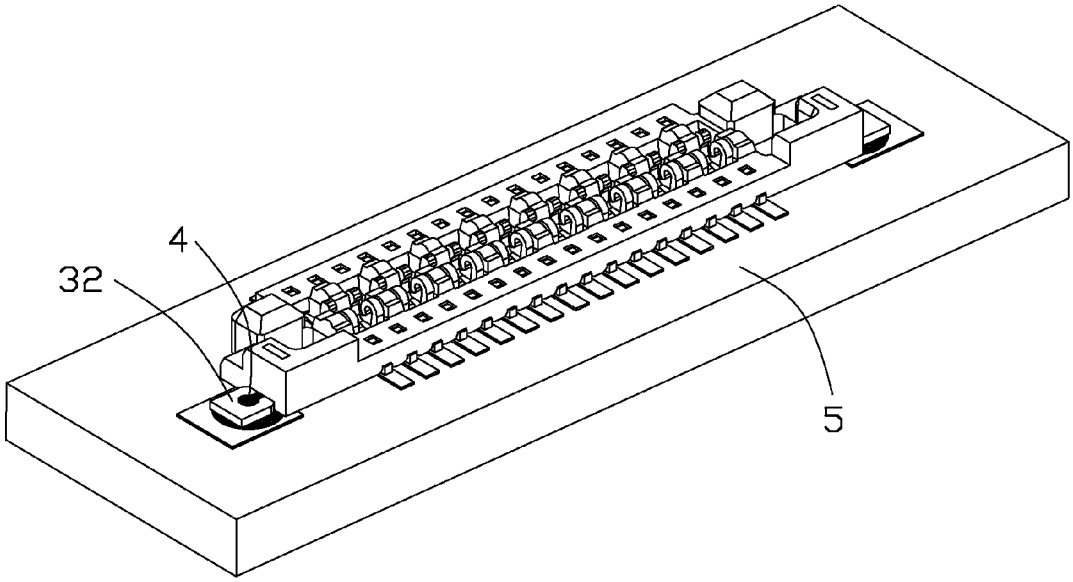
FIG. 5 is a perspective view of the plug connector or the receptacle connector mounted upon the PCB after soldering.
Figure 6:
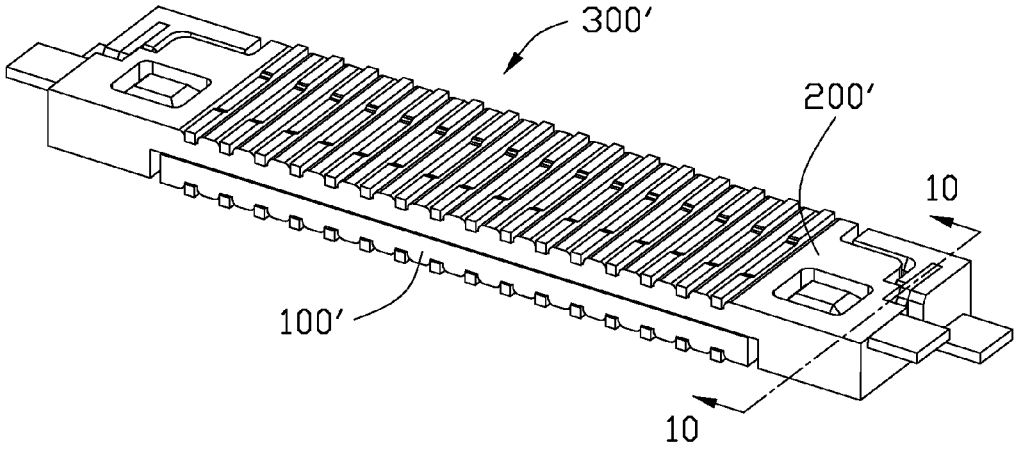
FIG. 6 is a perspective view of a board to board connector assembly with a plug connector and a receptacle connector mateable with each other in accordance with a second embodiment of the present disclosure.

Referring to FIG. 4, the first and second portions 31, 32 are insert molded in the shoulder 13 of the insulative housing so as to be integral therewith. Understandably, in such an insert molding process, the liquid insulative material for forming the insulative housing 1 actively fills in the first and the third holes 311, 331 as a result that the metal hold down 3 can be reliably fastened in the insulative housing 1. Besides, referring to FIG. 5, when the plug connector 100 is mounted upon a PCB 5 in a surface soldering process, solders 4 may easily enter into and fill in the second hole 321 as result that soldering quality thereof can be well improved.

Referring to FIGS. 6 to 9, a second embodiment of the present disclosure discloses another board to board connector assembly 300' similar to the board to board connector assembly 300 in the first embodiment. Since it is understandable to those of ordinary skill in the art, in combination with the FIGS. 1 to 5 and corresponding description of the first embodiment, to understand the board to board connector assembly 300', repeated description and similar description are omitted herein. In accordance with the second embodiment of the present disclosure, the board to board connector assembly 300' includes a plug connector 100' and a receptacle connector 200' which are truly identical for saving costs and reducing inventory.

Figure 7:
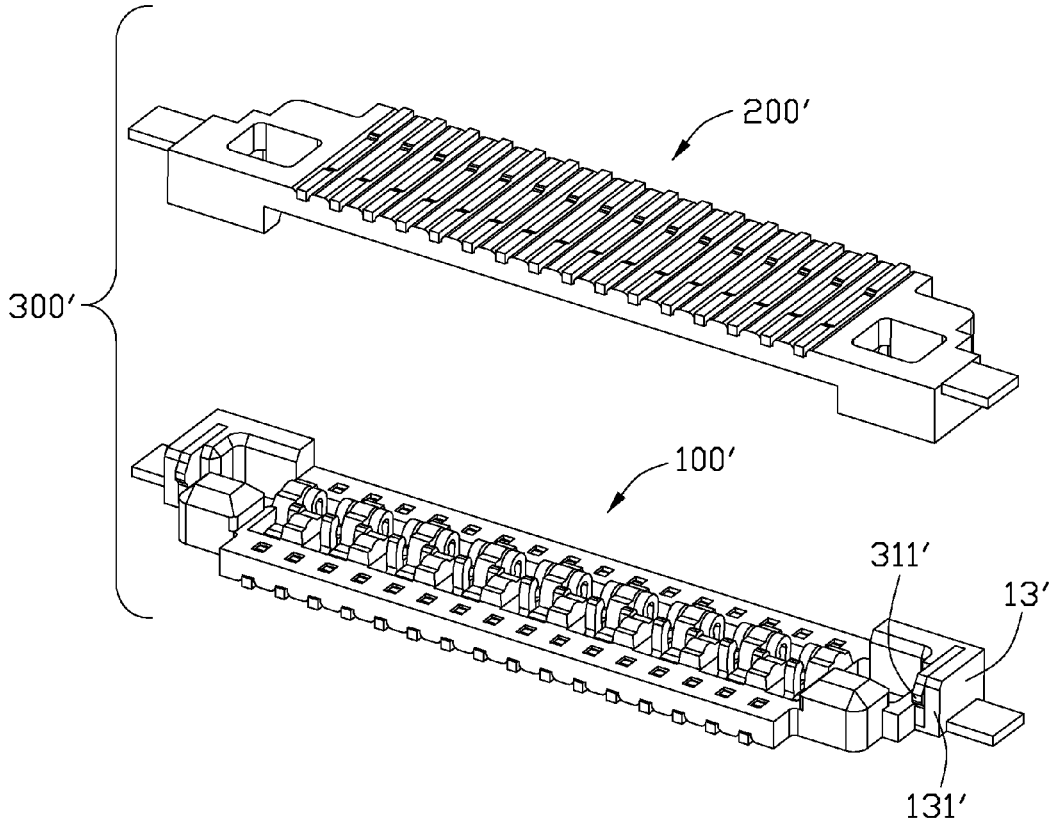
FIG. 7 is a perspective view of the board to board connector assembly as shown in FIG. 6 with the plug connector separated from the receptacle connector.
Figure 8:
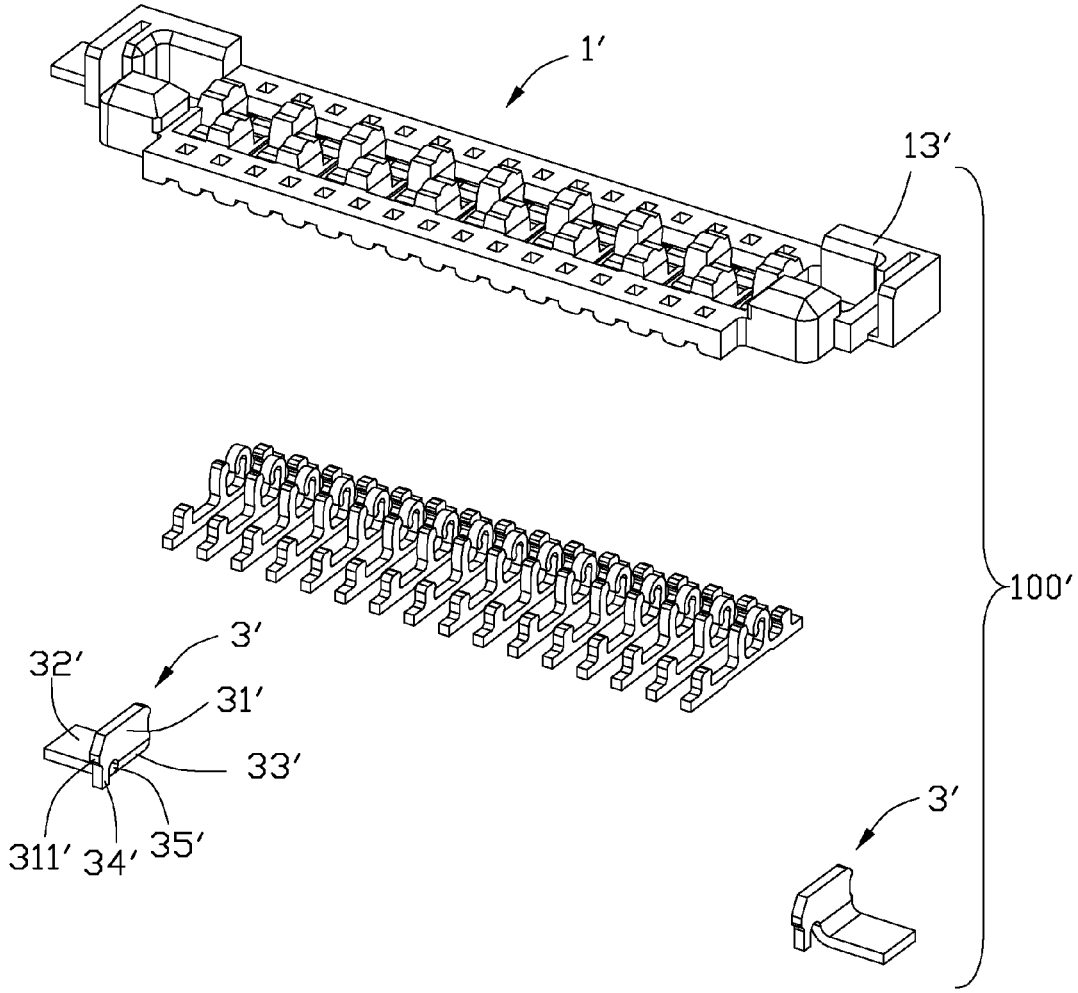
FIG. 8 is an exploded view of the plug connector or the receptacle connector with contacts and a pair of metal hold downs separated from an insulative housing.
Figure 9:
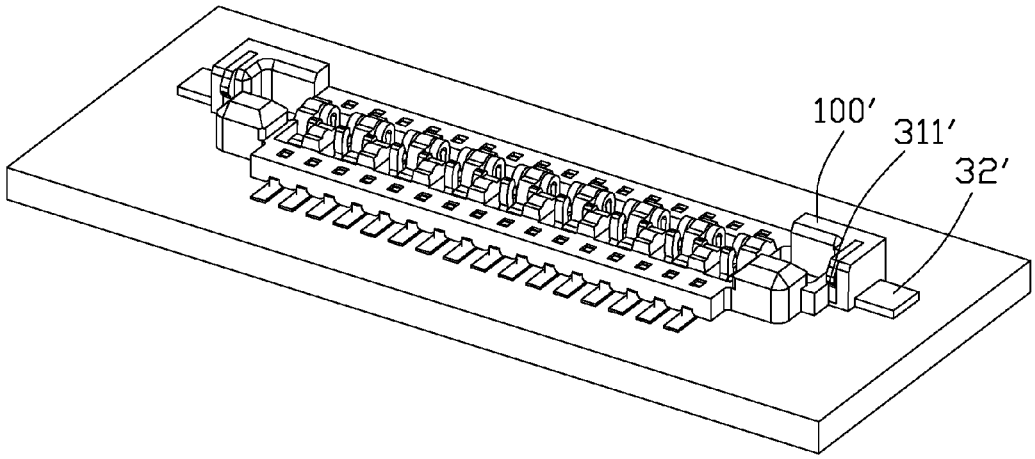
FIG. 9 is a perspective view of the plug connector or the receptacle connector mounted upon a PCB.

The main difference of the board to board connector assembly 300' and the board to board connector assembly 300 is the structure of the metal hold downs 3, 3'. In the second embodiment, each metal hold down 3' includes a first portion 31' located in a vertical plane, a second portion 32' located in a horizontal plane and a connecting portion 33' connecting the first and the second portions 31', 32'. Besides, the metal hold down 3' includes a reinforcement protrusion 34' extending downwardly from the first portion 31', and simultaneously a gap 35' is formed between the connecting portion 33' and the reinforcement protrusion 34'. The reinforcement protrusion 34' is coplanar with the first portion 31'. As shown in FIG. 7, the first portion 31' includes a protrusion 311' extending sidewardly beyond a side face 131' of the shoulder 13'.

Figure 10:
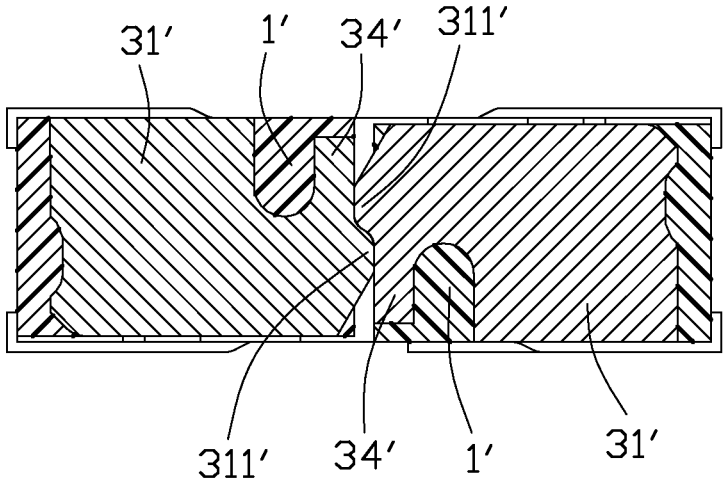
FIG. 10 is a cross-sectional view of the board to board connector assembly taken along line 10-10 of FIG. 6.

Referring to FIGS. 7 to 10, the first portion 31' and the connecting portion 33' are insert molded in the shoulder 13' of the insulative housing 1' as well. Understandably, in such an insert molding process, the liquid insulative material for forming the insulative housing 1' actively fills in the gap 35' as a result that the metal hold down 3' can be reliably fastened in the insulative housing 1'. Besides, as shown in FIG. 10, when the plug connector 100' and the receptacle connector 200' are mated, the protrusion 311' of the receptacle connector 200' overcomes and passes the protrusion 311' of the plug connector 100' so that the protrusions 311' are locked with each other along a vertical direction.

it is also noted that the invention provides only one structure for both two mated connectors for saving manufacturing cost. Under this situation, it is required to have the housing and the contact and the metal hold-downs to be symmetrically arranged with regard to the centerline extending along the lengthwise direction. Therefore, the protrusion structures and the recessed structures can be complementarily mated with each other when the two connectors are face to face coupled to each other in the vertical direction. In these embodiments, the pair of metal hold-downs are respectively located at two opposite ends of the housing while both located on the same side of the centerline; anyhow, they can be located respectively on two sides of the centerline alternately.

It is to be understood, however, that even though numerous, characteristics and advantages of the present disclosure have been set forth in the foregoing description, together with details of the structure and function of the invention, the disclosed is illustrative only, and changes may be made in detail, especially in matters of number, shape, size, and arrangement of parts within the principles of the invention to the full extent indicated by the broadest general meaning of the terms in which the appended claims are expressed.

What is claimed is:

1. An electrical connector comprising:

an insulative housing defining a longitudinal mating slot;

a plurality of contacts retained in the insulative housing, each contact comprising a contacting portion extending into the mating slot; and a pair of metal hold downs fastened in opposite ends of the insulative housing, each metal hold down comprising a first portion, a second portion perpendicular to the first portion and a connecting portion connecting the first portion and the second portion; wherein the first portion defines a first hole, the second portion defines a second hole for maintaining solders, and the connecting portion defines a third hole in communication with the first hole and the second hole; and wherein the first portion and the connecting portion are insert molded in the insulative housing with material of the insulative housing filling in the first and the third holes.

2. The electrical connector as claimed in claim 1, wherein the third hole is narrower than the first hole.

3. The electrical connector as claimed in claim 1, wherein the third hole is narrower than the second hole.

4. The electrical connector as claimed in claim 1, wherein both of the first hole and the second hole are round.

5. The electrical connector as claimed in claim 1, wherein the first portion is located in a vertical plane and the second portion is located in a horizontal plane.

6. The electrical connector as claimed in claim 1, wherein the connecting portion is narrower than either the first portion or the second portion.

7. The electrical connector as claimed in claim 1, wherein the insulative housing comprises a first mounting wall, a second mounting wall with the mating slot formed between the first mounting wall and the second mounting wall, an array of first positioning blocks integral with the first mounting wall, and an array of second positioning blocks integral with the second mounting wall.

8. The electrical connector as claimed in claim 7, wherein either the first positioning blocks or the second positioning blocks are arranged in a longitudinal direction while the first positioning blocks and the second positioning blocks are offset from each other along a transverse direction perpendicular to the longitudinal direction.

9. The electrical connector as claimed in claim 8, wherein each contacting portion is located adjacent to and sidewardly depends on corresponding the first or the second positioning blocks.

10. The electrical connector as claimed in claim 1, wherein the electrical connector is hermaphroditic.

11. An electrical connector comprising:

an insulative housing;

a plurality of contacts retained in the insulative housing; and a pair of metal hold downs fastened in opposite ends of the insulative housing, each metal hold down comprising a first portion, a second portion perpendicular to the first portion, a connecting portion connecting the first portion and the second portion, and a reinforcement protrusion extending downwardly from the first portion, a gap being formed between the connecting portion and the reinforcement protrusion; wherein the first portion and the connecting portion are insert molded in the insulative housing with material of the insulative housing filling in the gap.

12. The electrical connector as claimed in claim 11, wherein the first portion is located in a vertical plane and the second portion is located in a horizontal plane.

13. The electrical connector as claimed in claim 12, wherein the reinforcement protrusion is coplanar with the first portion.

14. The electrical connector as claimed in claim 11, wherein the insulative housing comprises a first mounting wall, a second mounting wall with the mating slot formed between the first mounting wall and the second mounting wall, an array of first positioning blocks integral with the first mounting wall, and an array of second positioning blocks integral with the second mounting wall.

15. The electrical connector as claimed in claim 14, wherein either the first positioning blocks or the second positioning blocks are arranged in a longitudinal direction while the first positioning blocks and the second positioning blocks are offset from each other along a transverse direction perpendicular to the longitudinal direction.

16. The electrical connector as claimed in claim 15, wherein each contacting portion is located adjacent to and sidewardly depends on corresponding the first or the second positioning blocks.

17. An electrical connector assembly comprising:

a connector for face to face mating with a complementary connector which is same with said connector, said connector including:

an elongated insulative housing defining a lengthwise direction and a transverse direction perpendicular to each other;

said housing defining a centerline along said lengthwise direction to form first and second halves by two sides of the centerline in the transverse direction;

said housing further defining a horizontal mating face, which faces upward in a vertical direction perpendicular to both said lengthwise direction and said transverse direction, for face-to-face confrontation with another horizontal mating face of the complementary connector in said vertical direction;

a plurality of contacts disposed in the housing along the lengthwise direction and extending upwardly above the mating face; and said housing further defining a plurality of protrusions extending above the horizontal face and a plurality of cavities downward recessed from the mating face; wherein said protrusions and said cavities are symmetrically arranged with each other by two sides of the centerline along the transverse direction in a mutually complementary manner for allowing the complementary connector which is same with said connector to mate with said connector in said vertical direction in the mutually complementary manner.

18. The electrical connector assembly as claimed in claim 17, wherein said connector further includes a pair of metal hold-downs respectively located at two opposite ends of said lengthwise direction.

19. The electrical connector assembly as claimed in claim 18, wherein each of said metal hold-downs defines a hook structure along a transverse plane perpendicular to said lengthwise direction.

20. The electrical connector assembly as claimed in claim 17, wherein each of said contacts defines an engagement structure along a transverse plane perpendicular to said lengthwise direction.

* * * * *